United States Patent [19]

Eldin et al.

[11] 4,145,247

[45] Mar. 20, 1979

[54] COMPOSITION, FOR THE TREATMENT OF PAPER, WHICH CONTAINS HYDANTOIN COMPOUNDS AND AN AMINE CURING AGENT

[75] Inventors: Sameer H. Eldin, Birsfelden; Wolfgang Seiz, Pfeffingen; Ewald Forster, Allschwil, all of Switzerland

[73] Assignee: Ciba-Geigy Corporation, Ardsley, N.Y.

[21] Appl. No.: 806,573

[22] Filed: Jun. 14, 1977

[30] Foreign Application Priority Data

Jun. 25, 1976 [CH] Switzerland ..... 8158/76

[51] Int. Cl.[2] ..... D21F 11/00

[52] U.S. Cl. ..... 162/136; 162/158; 427/369; 427/395

[58] Field of Search ..... 162/158, 164 EP; 260/309.5; 8/181, 194; 427/395, 391, 369, 370; 162/135, 136

[56] References Cited

U.S. PATENT DOCUMENTS

| | | | |
|---|---|---|---|
| 2,913,356 | 11/1959 | Schroeder | 162/164 EP |
| 3,505,270 | 4/1970 | Laden | 156/187 |

FOREIGN PATENT DOCUMENTS

| | | |
|---|---|---|
| 1148570 | 4/1969 | United Kingdom. |
| 1165060 | 9/1969 | United Kingdom. |
| 1290728 | 9/1972 | United Kingdom. |

*Primary Examiner*—Richard V. Fisher
*Assistant Examiner*—Peter Chin
*Attorney, Agent, or Firm*—Edward McC. Roberts

[57] ABSTRACT

A composition for the treatment of paper which improves the wet strength of paper is provided. This composition contains (a) a water-soluble mono- or binuclear hydantoin compound containing glycidyl groups, and (b) a water-soluble amine with at least two active amine hydrogen atoms, e.g. an aliphatic polyamine, as curing agent.

Also a process for the treatment, preferably the surface treatment of paper with the above composition is provided.

19 Claims, No Drawings

COMPOSITION, FOR THE TREATMENT OF PAPER, WHICH CONTAINS HYDANTOIN COMPOUNDS AND AN AMINE CURING AGENT

The invention relates to a composition for the treatment of paper. It serves, in particular, to improve the wet strength of paper.

Paper produced in the usual way normally has an adequate tear strength in the dry state. This property is due to the hemicellulose constituents, which swell in water. In the swollen state, they bind the paper fibres loosely to one another and this bond remains intact on drying and strengthens. On wetting again, the hemicellulose particles swell again and this results in a weakening of the bonding points between the fibres. However, paper with a high wet tear strength is demanded for a number of applications, for example when the paper is converted to sacks for fertilisers, potatoes and the like, for packing flowers or frozen foodstuffs, such as fish, vegetables or ice cream, or to wallpapers, refuse bags, handkerchiefs and facial tissues and the like, and also when it is used to manufacture articles which are used outdoors, such as maps, labels, posters, notepad and programmes for sporting events.

There have already been numerous proposals for increasing the wet strength, which usually amounts to about 2 to 8% of the dry strength. Products based on aminoplasts, that is to say products which contain formaldehyde, are used for this purpose. Most of these and other products which can increase the wet tear strength of paper do not have good compatibility with paper additives, such as optical brighteners or starch, because of their ionic action.

The additives can either be added to the pulp or, in particular, be applied as impregnating agents to the finished paper. When added to the pulp, anionic products are effective only in the presence of aluminum ions and non-ionic products have little effect; only the addition of cationic agents to the pulp is able to increase the wet strength of the paper considerably. Such differences between anionic, non-ionic and cationic agents cannot be detected when paper webs are impregnated.

A process for imparting wet tear strength to paper is known from U.S. Pat. No. 2,913,356 and in this process a conventional polyglycidyl ether and a curing agent for epoxide resins are added to the paper in an aqueous medium. Both the wet tear strength and the dry tear strength of paper treated in this way are inadequate. It was not to be foreseen that other compounds containing epoxide groups would show substantially better results.

It has now been found, surprisingly, that a formaldehyde-free mixture which contains one or more polyglycidylhydantoin compounds and a water-soluble amine and which can be manufactured simply, does not precipitate in dilute solutions and can be stored for several days, considerably increases the wet strength of paper when the paper is impregnated therewith. The fact that the components of the mixture can be manufactured, stored and despatched in concentrations of up to 100% is particularly advantageous.

The subject of the invention is, therefore, a composition, for the treatment of paper, which is characterised in that it contains (a) at least one water-soluble hydantoin which contains several glycidyl groups, especially a correspondingly substituted hydantoin compound which is optionally substituted in the 5-position of the hydantoin ring or hydantoin rings, and (b) as the curing agent, a water-soluble amine with at least two active amine hydrogen atoms. The components (a) are, in particular, mononuclear or bi-nuclear hydantoin compounds with two glycidyl groups, which are bonded direct or via a bridge member to the nitrogen atoms of the hydantoin ring.

Possible bridge members are, for example, straight-chain or, preferably, branched alkylene chains and oxyalkylene chains with 1 to 4 carbon atoms. Branched oxyalkylene chains are particularly preferred. Oxyisopropylene of the formula $—CH_2—CH(CH_3)—O—$ is of primary interest. In the case of the binuclear hydantoin compounds, the two hydantoin nuclei are again preferably linked via bridge members of this type and the bridge member is optionally substituted by a glycidyl group. Accordingly, preferred binuclear hydantoin compounds contain a total of 3 glycidyl groups.

Hydantoin compounds which are substituted in the 5-position are preferred. Possible substituents in the 5-position of the hydantoin ring of the mononuclear compounds or of the hydantoin rings of the binuclear compounds are phosphonalkylene groups which are optionally etherified by alkyl with 1 to 4 carbon atoms or, in particular, alkyl groups with 1 to 4 carbon atoms. Etherified phosphonoalkylene groups with 2 to 6 carbon atoms in the alkylene radical, for example diethoxyphosphono-2,2-dimethyl-ethyl, are preferred. The 5-position of the hydantoin ring or of the hydantoin rings is as a rule substituted by at most one such phosphonoalkylene group.

A possible further substituent is, above all, alkyl with 1 to 4 carbon atoms, preferably isopropyl and in particular ethyl and methyl, and hydantoin compounds which are substituted in the 5-position by methyl and isopropyl or methyl and ethyl or especially by two methyl radicals are of primary interest.

Compounds which can additionally be mixed with the hydantoin compounds of the indicated type, which contain several glycidyl groups, are those which are also based on hydantoins, which contain only one glycidyl group and which are also substituted in the 5-position, preferably as mentioned above, and in the 3-position, preferably by alkyl or, in particular, hydroxyalkyl with 1 to 4 carbon atoms.

The compounds of the following formulae may be mentioned as examples of mononuclear hydantoin compounds with two glycidyl groups:

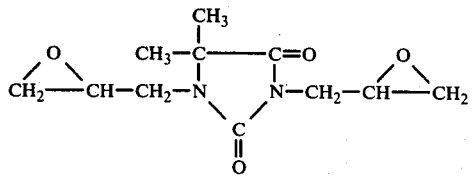

(1)

-continued (2)

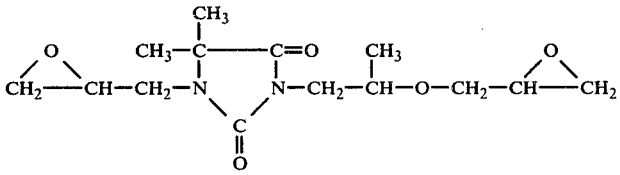

(3)

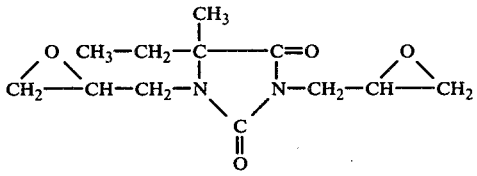

Further representatives of such mononuclear hydantoin compounds are, for example, 5-isopropyl-5-methyl-1,3-diglycidylhydantoin and 5-(diethoxyphosphono-2,2-dimethyl-ethyl)-5-methyl-1,3-diglycidyl-hydantoin.

The compound of the formula (4)

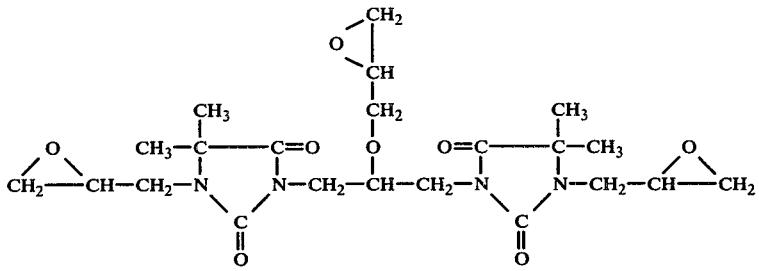

may be mentioned as an example of a binuclear hydantoin compound with two glycidyl groups.

The compound of the formula (5)

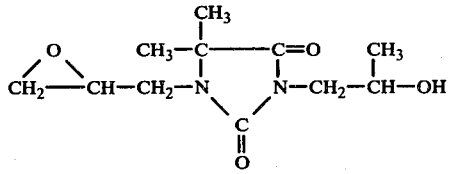

may be mentioned as an example of a mononuclear compound which contains only one glycidyl group.

The compounds of the formulae (1) to (4), which optionally are mixed with the compound of the formula (5), are preferred. A mixture of the compounds (1), (2) and, optionally, (5), above all in a weight ratio of components (1):(2) of about 7:3 or of components (1):(2):(5) of about 7:2.5:0.5 is of particular importance.

As a rule, hydantoin compounds of this type have an epoxide content of 5.5 to 8.0 epoxide group equivalents/kg.

The abovementioned hydantoin compounds can be manufactured by known methods, such as are described, for example, in British Patent Specification Nos. 1,148,570, 1,165,060 or 1,290,728.

Curing agent components which can be used are polyamines, above all aliphatic polyamines, preferably tetramines, triamines and especially diamines.

Amongst the preferred diamines, dialkyldiamines of the formula (6)

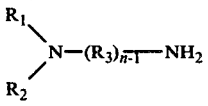

in which $R_1$ and $R_2$ each denote alkyl with 1 to 4 carbon atoms, preferably ethyl and especially methyl, and $R_1$ and $R_2$ preferably have the same meaning, $R_3$ denotes alkylene with 1 to 4 carbon atoms, preferably ethylene and n-propylene, and n denotes 1 or preferably 2, can be used above all. Dimethylhydrazine, N,N-dimethylaminothylamine, N,N-diethylaminopropylamine and especially N,N-dimethylaminopropylamine may be mentioned as specific representatives of the formula (6), which are of primary interest.

As a rule, dialkyldiamines of this type have an active hydrogen content of 30 to 70 hydrogen equivalents/kg.

In the compositions according to the invention, the components (a) and (b) are preferably present in amounts such that the equivalent ratio of the epoxide group content of (a) to the active amine hydrogen content of (b) is 1:0.2 to 1:1 and preferably 1:0.3 to 1:0.6.

When the paper is treated with the compositions, according to the invention, of components (a) and (b), these can be added to the paper pulp. However, wet-strength treatment at the surface of the paper, for which the paper is impregnated with the compositions according to the invention, is preferred to this wet-strength treatment in the paper pulp.

Impregnation of the paper, which can be in the form of webs, is effected with an aqueous solution of the composition, according to the invention, of components (a) and (b). The concentration is 0.1 to 20, preferably 0.1 to 10, percent by weight, relative to the weight of paper (dry fibre), depending on the desired wet strength and the nature of the paper. In particular, solutions which have an active substance content of 0.5 to 2, and preferably about 1, percent by weight are used.

The pH value of the impregnating solutions is as a rule 9 to 12 and especially 10.2 to 11.2.

The impregnated paper is squeezed off, advantageously until an amount of 0.1 to 10, and preferably 1, percent by weight, relative to the weight of paper, of the water-soluble substances remains on the paper.

In the paper industry, on an industrial scale, the paper is subsequently dried, for example on heated cylinders, and stored at room temperature, in a so-called maturing process, for 5 to 20 days, during which time the resin which has been applied cures completely on the paper. Under laboratory conditions, this drying and the maturing process are imitated by first drying the paper at room temperature and then subjecting it to a heat treatment at a temperature above 100° C., whereupon the resin which has been applied to the paper cures completely as in the industrial maturing process.

As a rule, drying at room temperature takes 20 to 40 minutes. The heat treatment is preferably carried out at 110° to 200° C. and especially at 120° to 140° C. for 10 to 100, and especially 20 to 40, minutes.

Although less preferred, it also possible to apply the components (a) and (b) of the composition according to the invention separately to the paper, that is to say to impregnate the paper only with component (a) in the form of a dilute, aqueous, approximately 1% strength solution and to dry it and then to impregnate it with component (b), also in the form of a dilute aqueous solution, and to dry it and subsequently to cure the paper.

The compositions according to the invention impart advantageous high wet tear strength and dry tear strength to the paper treated therewith.

In addition, the components (a) and (b), contained in the compositions according to the invention, can be stored and transported in the concentrated state.

The parts and percentages indicated in the Examples which follow are parts by weight and percentages by weight.

EXAMPLE 1

Paper made of pure cellulose with a weight per unit area of 200 g/m$^2$ is impregnated with a 1% strength aqueous solution of a mixture A consisting of 70 parts of the compound of the formula (1), 30 parts of the compound of the formula (2) and 13.8 parts of N,N-dimethylaminopropylamine in a vat using a squeezing roll, so that 1%, relative to the paper, of the water-soluble substances remains on the paper. The measured epoxide content of the hydantoin mixture used in mixture A is 7.27 epoxide group equivalents/kg and the active hydrogen content of the amine used in mixture A is 51.09 equivalents of hydrogen/kg. Mixture A thus has an equivalent ratio of the epoxide group content of the hydantoin mixture to the active amine hydrogen content of 1:0.37. The aqueous solution, which contains 1% of mixture A, has a pH value of 10.7.

For practical reasons, the content of water-soluble substances which have remained on the paper is determined by weighing the paper before impregnating and immediately after squeezing off in the wet state, since weighing of the paper which has already been dried is rendered virtually impossible because of the highly hydrophilic nature of the paper.

The impregnated paper is dried for 30 minutes at room temperature and then subjected to a heat treatment at 130° C. for 30 minutes. 140 mm × 15 mm strips are cut out of this paper and weighed and subjected to a tensile stress in a tearing machine until the strips tear. The tear strength is determined dry (dry tear strength) and after storing for one hour in distilled water (wet tear strength). The results are expressed as the tear length in meters, the number of meters designating the length of the paper strip at which the strip would tear under its own weight.

The relative wet tear strength in % is the ratio of the tear length of the paper in the wet state (=W) to that in the dry state (=D) multiplied by 100, that is to say:

$$S\ relative = (W \times 100)/D$$

The average value from 10 measurements gives

| | | | |
|---|---|---|---|
| dry tear length | D | = | 1,926 m |
| wet tear length | W | = | 801 m |
| relative wet tear strength | S relative | = | 41.5% |

EXAMPLE 2

The procedure is as indicated in Example 1 but the paper is impregnated with a 1% strength aqueous solution of a mixture B of the following composition:

| | | |
|---|---|---|
| 75 | parts of the compound of the formula (1) | (epoxide content: 7.27 equivalents/kg) |
| 25 | parts of the compound of the formula (2) | |
| 5 | parts of the compound of the formula (5) | |
| 21.9 | parts of N,N-dimethylhydrazine | (active hydrogen content: 30.05 equivalents/kg |

Mixture B has an equivalent ratio of epoxide:hydrogen of 1:1 and its 1% strength aqueous solution has a pH value of 11.1.

After drying the impregnated paper and subjecting it to heat treatment at 140° C. for 90 minutes, the following tear lengths and tear strength are measured as indicated in Example 1:

| | |
|---|---|
| dry tear length : | 1,792 m |
| wet tear length : | 800 m |
| relative wet tear strength : | 44.6% |

EXAMPLE 3

Good tear lengths and tear strengths of the treated paper are again obtained when the procedure followed is as in Example 1 but the paper is impregnated with mixtures C to H of the following compositions:

Mixture C 100 parts of the compound of the formula (4) (epoxide content: 6.04 equivalents/kg) and 11.5 parts of N,N-dimethylaminopropylamine (active hydrogen content: 51.09 equivalents/kg).

Equivalent ratio epoxide: hydrogen of mixture C: 1:0.38 pH value of its 1% strength solution: 10.4

Mixture D 100 parts of the compound of the formula (1) (epoxide content: 7.85 equivalents/kg) and 14.8 parts of N,N-dimethylaminopropylamine (active hydrogen content: 51.09 equivalents/kg).

Equivalent ratio epoxide:hydrogen of mixture D: 1:0.37 pH value of its 1% strength solution: 10.9.

Mixture E 100 parts of the compound of the formula (2) (epoxide content: 6.0 equivalents/kg) and 11.3 parts of N,N-dimethylaminopropylamine (active hydrogen content: 51.09 equivalents/kg).

Equivalent ratio epoxide:hydrogen of mixture E: 1:0.37 pH value of its 1% strength solution: 10.3.

Mixture F 100 parts of the compound of the formula (3) (epoxide content: 7.50 equivalents/kg) and 15.1 parts of N,N-dimethylaminopropylamine (active hydrogen content: 51.09 equivalents/kg).

Equivalent ratio epoxide:hydrogen of mixture F: 1:0.4.

pH value of its 1% strength solution: 10.7.

Mixture G 75 parts of the compound of the formula (1)
25 parts of the compound of the formula (2) } (epoxide content: 7.27 equivalents/kg)
5 parts of the compound of the formula (5)

12.6 parts of N,N-diethylamino-propylamine (active hydrogen content: 65.11 equivalents/kg).

Equivalent ratio epoxide:hydrogen of mixture G: 1:0.26 pH value of its 1% strength solution: 10.6.

Mixture H 75 parts of the compound of the formula (1)
25 parts of the compound of the formula (2) } (epoxide content: 7.27 equivalents/kg)
5 parts of the compound of the formula (5)

13.0 parts of N,N-dimethylamino-ethylamine (active hydrogen content: 4.07 equivalents/kg).

Equivalent ratio epoxide:hydrogen of mixture H: 1:0.4.

pH value of its 1% strength solution: 10.7.

EXAMPLE 4

In accordance with Example 1, paper made of pure cellulose with a weight per unit area of 200 g/m$^2$ is impregnated with a 1% strength aqueous solution of mixture A, according to the invention, and further treated, and tested to determine its tear strength, in the same way.

For comparison, paper strips of the same quality are impregnated with mixtures which contain the resin components W, X, Y, and Z, which are known from U.S. Pat. No. 2,913,356 and are indicated in Table I which follows, in place of the hydantoin compounds.

In each case, 100 parts of these resin components are warmed to 100° C. with 10 parts of a non-ionic emulsifier and solubilising agent (based on ethylene oxide and hydrogenated castor oil), whilst stirring. 100 parts of a 5% strength polyvinyl alcohol solution are then mixed in, the whole is diluted with water and the corresponding amount (see Table I) of the same amine curing agent as in Example 1 is provided. The emulsions are diluted to a solids content of 0.9%, so that the solids content remaining on the paper after impregnating, squeezing off and drying is 1 ± 0.02%. Curing is carried out for 30 minutes at 130° C., as indicated in Example 1.

The results for the tear lengths and tear strength as the average values from 10 measurements, the values being measured as in Example 1, can be seen from Table II.

TABLE I

| Designation of the mixture | Resin components | Viscosity cP at 25° C | Epoxide group content (equivalents/kg) | Amount of resin component (parts) | Amount of N,N-dimethylaminopropylamine*) (parts) | Equivalent ratio epoxide: hydrogen | pH value of the 0.9% strength emulsion |
|---|---|---|---|---|---|---|---|
| A | hydantoin compound of the formula (1) | 1,240 | 7.27 | 70 | 13.8 | 1:0.37 | 10.7 |
| | hydantoin compound of the formula (2) | 1,203 | | 30 | | | |
| W | liquid bisphenol A diglycidyl ether | 10,000 | 4.9–5.7 | 100 | 14.1 | 1:0.48 –1:0.56 | 10.9 |
| X | glycerol di-and tri-glycidyl ethers | 90–150 | 6.3–7.0 | 100 | 13.5 | 1:0.38–1:0.42 | 10.6 |
| Y | 1,2,6-hexanetriol di-and tri-glycidyl ethers | 115 | 6.7–6.8 | 100 | 11.8 | 1:0.34 | 10.7 |
| Z | pentaerythritol tetraglycidyl ether | 380 | 7.2 | 100 | 10 | 1:0.27 | 10.9 |

*)active hydrogen content : 51.09 equivalents/kg

TABLE II

| Designation of the mixture | Wet tear length m | Dry tear length m | Relative wet tear strength % |
|---|---|---|---|
| A | 787 | 1,872 | 41.6 |
| W | 481 | 1,352 | 35.6 |
| X | 387 | 1,245 | 31.1 |
| Y | 378 | 1,250 | 11.8 |
| Z | 94 | 1,095 | 8.6 |

The tear lengths and tear strength of paper which has been treated with composition A, according to the invention, are distinctly superior to those of paper which has been impregnated with the mixtures W to Z of known resin components and an amine curing agent.

What is claimed is:

1. A process to improve the wet strength of paper, comprising the steps of impregnating the paper with an effective amount of components (a) at least one water-soluble hydantoin which contains two or more glycidyl groups and (b) a water-soluble amine curing agent with at least two active amine hydrogen atoms, and curing at room temperature or by heat treatment.

2. The process of claim 1, wherein the paper is first impregnated with component (a), and then with component (b).

3. The process of claim 1, wherein the hydantoin is mononuclear or binuclear and is substituted in the 5-position or positions by alkyl of 1 to 4 carbon atoms, or a phosphonoalkylene of 2 to 6 carbon atoms which is not etherified or is etherified by alkyl of 1 to 4 carbon atoms.

4. The process of claim 1, wherein the hydantoin is selected from the group consisting of 1,3-diglycidyl-5,5-dimethylhydantoin, 1-glycidyl-3-oxypropylglycidyl-5,5-dimethyl-hydantoin, 1,3-diglycidyl-5-methyl-5-ethyl-hydantoin, 1,3-bis-(1-glycidyl-5,5-dimethylhydantoinyl-3)-2-glycidyloxypropane or a mixture of 1,3-diglycidyl-5,5-dimethyl-hydantoin and 1-glycidyl-3-oxypropylglycidyl-5,5-dimethyl-hydantoin.

5. The process of claim 1, wherein the paper is impregnated with an aqueous solution of components (a) and (b), squeezed off, dried and then cured.

6. The process of claim 5 wherein the paper is dried at room temperature for 20 to 40 minutes and then cured by heating at 110° to 200° C. for 10 to 100 minutes.

7. The process of claim 5, wherein the aqueous solution contains 0.5 to 2% by weight of components (a) and (b) and is at a pH of 9 to 12.

8. The process of claim 5, wherein the aqueous solution contains 0.1 to 20% by weight of components (a) and (b) in a ratio (a):(b) of 1:0.2 to 1:1, based on the equivalent weights of (a) relative to the epoxide group content and of (b) relative to the active hydrogen content, and wherein the impregnated paper is squeezed off to leave 0.1 to 10 percent by weight, relative to the paper, of the aqueous solution.

9. The process of claim 8, wherein the aqueous solution contains 0.5 to 2% by weight of components (a) and (b), and the paper is left with about 1% by weight of the aqueous solution after it is squeezed off.

10. The process of claim 1, wherein the hydantoin glycidyl groups are linked directly to the hydantoin nitrogen atoms or are linked thereto with a straight or branched alkylene or oxyalkylene chain of 1 to 4 carbon atoms.

11. The process of claim 10, wherein the hydantoin is binuclear and contains three glycidyl groups.

12. The process of claim 1, wherein component (a) further contains a monoglycidyl hydantoin.

13. The process of claim 12, wherein the monoglycidyl hydantoin is a 1- or 3-glycidyl hydantoin substituted in the 5-position by methyl groups or by a methyl group and an ethyl group, wherein the 1-glycidyl hydantoins are substituted in the 3-position by alkyl or hydroxyalkyl of 1 to 4 carbon atoms.

14. The process of claim 13, wherein the monoglycidyl hydantoin is 1-glycidyl-3-(2-hydroxypropyl)-5,5-dimethylhydantoin.

15. The process of claim 1, wherein the amine curing agent is a polyamine.

16. The process of claim 15, wherein the polyamine is an aliphatic diamine, triamine or tetramine.

17. The process of claim 16, wherein the aliphatic diamine is of the formula

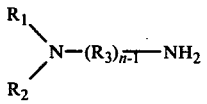

wherein $R_1$ and $R_2$ are each alkyl of 1 to 4 carbon atoms, $R_3$ is alkylene of 1 to 4 carbon atoms, and n is 1 or 2.

18. The process of claim 17, wherein the aliphatic diamine is dimethylhydrazine, N,N-dimethylaminoethylamine, N,N-diethylaminopropylamine or N,N-dimethylaminopropylamine.

19. Paper of improved wet strength which has been treated by a process comprising the steps of impregnating the paper with an effective amount of components (a) at least one water-soluble hydantoin which contains two or more glycidyl groups and (b) a water-soluble amine curing agent with at least two active amine hydrogen atoms, and curing at room temperature or by heat treatment.

* * * * *